US005472097A

United States Patent [19]

Villachica

[11] Patent Number: 5,472,097

[45] Date of Patent: Dec. 5, 1995

[54] DOCUMENT SORTING WORKSTATION AND METHOD

[76] Inventor: John Villachica, P.O. Box 5104, Wheatridge, Colo. 80034

[21] Appl. No.: 131,095

[22] Filed: Oct. 1, 1993

[51] Int. Cl.[6] ..... B07C 5/00

[52] U.S. Cl. ..... 209/546; 209/203; 209/900; 209/911; 209/942

[58] Field of Search ..... 209/44.4, 584, 209/703, 702, 900, 942, 546, 547, 548, 549, 911

[56] References Cited

U.S. PATENT DOCUMENTS

| | | | |
|---|---|---|---|
| 996,549 | 6/1911 | Wintermute | 209/703 X |
| 1,046,038 | 12/1912 | Sykes | 209/703 X |
| 1,136,571 | 4/1915 | Whittier | 209/900 X |
| 1,219,067 | 3/1917 | Bailey et al. | 209/900 X |
| 1,440,204 | 12/1922 | Acschuler | 209/703 X |
| 1,489,927 | 4/1924 | Caldwell | 209/703 X |
| 4,037,725 | 7/1977 | Roberts et al. | 209/702 |
| 4,337,866 | 7/1982 | Suling et al. | 209/900 X |

FOREIGN PATENT DOCUMENTS

| | | | |
|---|---|---|---|
| 2357150 | 1/1978 | France | 209/703 |
| 524268 | 4/1931 | Germany | 209/703 |
| 24601 | of 1913 | United Kingdom | 209/703 |
| 601885 | 5/1948 | United Kingdom | 209/702 |
| 2109762 | 6/1983 | United Kingdom | 209/702 |

*Primary Examiner*—D. Glenn Dayoan

*Attorney, Agent, or Firm*—Townsend and Townsend and Crew

[57] ABSTRACT

A document or package sorting workstation (10), ergonomically designed to maximize manual or machine-assisted sorting efficiencies and throughput, while minimizing or eliminating opportunities for losses or mis-sorts and improved methods for sorting documents and packages. The workstation (10) is made of an upper workstation (32) which is an inclined chute (14) with dividers (12) placed parallel to flow of documents or packages, and front stop (29); a lower workstation (28) having a support frame and receptacle for bag holder (24); a bag holder (24) having supporting frames and a glider (22); an accessory holder (30); and a loading shelf (16).

12 Claims, 7 Drawing Sheets

DOCUMENT SORTING WORKSTATION AND METHOD

BACKGROUND—FIELD OF INVENTION

This invention relates to apparatus and methods for the efficient manual sorting of documents and packages, specifically to the sorting of documents and packages common to courier and other shipping or mailing services.

BACKGROUND—DESCRIPTION OF PRIOR ART

The express courier industry has experienced substantial growth as more and more consumers take advantage of their services. Since packages and documents may originate in almost any location in the world and have as their destination most any international address, the processes used to sort, re-sort, transfer, and transport these documents and packages can be quite complex. A number of computer and machine-based systems, such as the Federal Express® Supertracker® scanner, computerized Astra® barcode labeling, and improved warehouse materials handling systems such as conveyors, have been employed to maximize shipping and tracking efficiencies. Despite the technological advances applied in this industry and in other mailing and shipping industries, there still exists a need for manual sorting and handling of documents and packages on a selected basis.

Efficient manual sorting has recently become more critical as express courier services implement new sorting demands on local shipping stations and as competition between carriers increases. In the past, much, if not all of the manual sorting required to move a document or package from origin to destination was done by one or a select few large, centrally located shipping stations that collect documents and packages from local stations and re-distribute them to other local stations for final delivery. Increased volumes have necessitated that now even local shipping stations perform various manual sorts on documents they collect which are bound for large stations and on documents they received from such stations for final delivery.

The general routing of a document during express shipment is as follows: 1) document pick up; 2) transport to a local shipping station; 3) sorting by an interim destination, commonly known as a "destination hub" or "hub"; 4) transport to a hub; 5) sorting by final destination shipping station; 6) transport to shipping station; 7) sorting by delivery route; and 8) delivery. Steps 1–4 are commonly referred to as an "outbound" shipment from the reference point of the local shipping station shipping them to a hub.. Steps 5–8 are commonly called an "inbound" shipment by a local shipping station receiving the documents. Manual sorting is used during both outbound and inbound shipments to group, assemble, split, or divide documents and packages according to their next destination.

Traditionally, a number of apparatus have been used to speed manual sorting. Generally, courier services rely on some kind of sorting table to split documents and packages into groups for outbound shipment according to destination hub. Similarly, sorting tables are used to facilitate the grouping of documents in inbound shipments for final delivery.

A number of such document sort tables have been designed the known features of which and associated disadvantages are described here:

(a) Flat horizontal tables: Difficult to move documents around on. Ergonomically unsatisfactory.

(b) Tables with only slight inclines (about 10 degrees or less) down which documents are placed: Documents move poorly down these inclines. Ergonomically unsatisfactory.

(c) Tables without boxed sides or dividers: Documents often fall off these tables or documents being separated are accidentally co-mingle with others.

(d) Tables without boxed fronts or with boxed fronts less than 23 cm deep: Documents slide off the front of the table.

(e) Tables constructed with gaps or crevices in their surfaces: Documents fall into these and may be lost.

(f) Tables constructed of materials such as plywood, framing lumber, particle board, Formica®: Short life cycles, heavy.

(g) Table tops constructed of metal: Heavy, expensive. Metal sheathing over wood may not last long.

(h) Tables without attached holders for holding a bag or similar container into which sorted documents are placed: Sorters must visually locate the correct bag (often leads to errors). May require excessive movement by sorter leading to fatigue or strain.

(i) Tables featuring a shelf which swings up from below the table on transverse pivots and holds destination bags: Pulling up shelf and locking in place ergonomically unsatisfactory. Bag holders have fabric bottoms and flimsy metal frames which are unstable.

(j) Tables without holders or attachments for sorting tools (e.g., pens, markers, labels, scanners, and printers): Equipment difficult to locate during a sort, equipment breakage and loss.

(k) Tables without a shelf onto which can be placed totes or containers of documents for unloading onto the sort tables: Ergonomically unsatisfactory.

(l) Tables designed for use by two or more sorters at a time, sorting into a common set of destination bags or totes: Leads to document collisions and loss, errors.

(m) Tables with general dimensions unsuited to body ergonomics, e.g., height from floor to sorting surface of about 84–89 cm or more: May lead to strain, repetitive movement injury.

(n) Tables designed for either inbound or outbound sorts, but not both. In particular, inbound sorts require a different holder for holding destination containers than the holders required for outbound sorts. Higher equipment costs.

(o) Expensive design and construction: Higher equipment costs.

Many of these tables are designed such that a document or package could fall from the table or fall into a crevice and not be sorted or shipped onward. This, alone or in combination with errors in sorting induced by inadequate sort table designs often leads to so called "mis-sorts". Mis-sorts occur when a document is either lost and not shipped onward or shipped onward to the incorrect destination. Mis-sorts are a serious problem for an industry that commonly guarantees delivery within a certain time period. Accordingly, mis-sorts are expensive for express carriers and may also result in customer dissatisfaction.

Most sort tables are physically separate from the bags or totes (and holders for same) into which the sorted documents or packages are placed. During a manual sort using these tables, the sorter must grasp a document, scan its label, optionally add a label, visually locate the correct destination bag or tote, then turn, stoop, or walk to place the document in the appropriate bag or tote, and finally label the bag or tote according to its predetermined destination.

No traditional sort table features mountings for holding sorting tools within easy reach of sorters.

During periods of large volume which exceed the carrying capacity of the sort tables, documents and packages may be simply spread across a floor surface since traditional sort tables do not have the capability to be expanded or joined modularly.

Sort methods employed with traditional sort table designs and their respective disadvantages include the following:

(a) Unsorted documents to be shipped outbound are collected from pick-up vehicles or customer drop off points. Documents may be sorted into destination groups and then placed on sort tables for secondary "check sorts", scanning. and final grouping in containers for shipment to the next destination. The sort performed before placing documents on the sort tables is complex, involving many documents and multiple destinations and destination containers. Mis-sorts commonly occur in these situations.

(b) Unsorted documents are dumped directly onto sort tables and are sorted by one or more persons into multiple destination containers. This process may be repeated (i.e., a rough sort followed by a fine sort). Sorted documents are then "check sorted", scanned, and bagged for shipment to the next destination. Multiple sorters sorting documents with multiple destinations from a single sort table to multiple destination containers can be chaotic, leading to mis-sorts. The problem is further compounded by document collisions. This type of sort method is illustrated in FIG. 1 and FIG. 1*a*—Prior Art.

(c) Some sort methods share one common feature which is the use of computer or machine-based scanners during the sort process. Scanners are used during an inbound sort to verify receipt at a local shipping station. They are also used during outbound sorts to record a document is en route to a hub destination. Scanners used during a sort are generally the same scanners used by a sorting courier in the course of the day's work and are used during sorts in any number of pre-programmed configurations. Often, scanners used during outbound sorts are programmed to accept documents heading for any number of destination hubs. While scanners are sometimes used to record that documents are being shipped in- or outbound(before the documents are placed in any one of a multitude of totes), they may not be used to serve as an additional check sort or mis-sort alarm.

It's clear what's needed are sort tables, or integrated workstations, and associated sort methods that overcome these problems and design deficiencies, while working in concert with machine-based and general shipping systems. Of particular need are workstations that can be used for a multiplicity of different sorts, e.g., inbound and outbound, without excessive effort being required to alter their physical layout or design before each type of sort. These are the aims of the workstation and methods which are the subject of the present invention.

Note the terms, "documents" or "packages" or "documents and packages", as used herein include, but are not limited to objects such as, envelopes, mailers, wrapped packages, enclosed documents, and parcels.

OBJECTS AND ADVANTAGES

Several objects and advantages of the present invention are:

(a) No crevices into which documents or packages may fall and create mis-sorts.

(b) A retractable and extendible holder, ergonomically and conveniently integrated with the workstation design, that holds bags, totes, or similar containers into which sorted documents may be placed without the sorter moving from the workstation or their sorting position.

(c) A tool or accessory holder, ergonomically and conveniently integrated with the workstation design, that holds labels, scanners, printers, markers, etc. and keeps them within reach of the sorter and furthermore increases efficiency and accuracy of the sort by physically associating these tools with a single sort table or sort table segment or slide.

(d) A separate, but integrated, shelf unit onto which bags, totes, or containers of unsorted documents or packages may be placed for unloading onto the workstation.

(e) A portable, modular design which allows workstations to be moved, arranged, and even linked according to need and according to volume.

(f) Tough, long-lived materials of construction that also feature colors and/or coatings that increase visual acuity during sorting operations.

(g) A flow-through design which allows for orderly and efficient sorting of documents and packages. and thus decreases labor costs minimizes or eliminates errors associated with mis-sorts and decreases associated expense.

(h) An overall ergonomically correct design which reduces operator fatigue or injury from repetitive movements.

(i) Design dimensions and characteristics which allow for high volume use and ordered document or package flow-through without loss or damage.

(j) A design usable for both outbound and inbound sorts.

(k) An improved method of sorting which includes pre-sorting documents as they are picked up (on-board sorting) and the use of a scanner, preprogrammed for only one destination and physically associated with only one sort table segment, to virtually eliminate mis-sorts.

DRAWING FIGURES

FIG. 1 shows a top view schematic of a commonly used inbound sort method in the prior art.

FIG. 1*a* shows a schematic of the flow of unsorted documents onto a sort table and into multiple destination totes, also from the prior art.

FIG. 2 shows an exploded view of a workstation

FIG. 2*a* shows a schematic illustration of a top view of a workstation and how documents flow using improved methods of sorting.

FIG. 3 shows a schematic of another improved sorting method.

FIG. 4 illustrates that the local shipping station which served as a test site for the present invention leads all other stations in its geographic region in the throughput of packages per handling hour. A handling hour is an hour time period spent sorting an outbound shipment. This data was collected nine months after implementation of the invention.

FIG. 5 further illustrates improvements in sorting and handling efficiencies after implementation of the present invention at the local shipping station test site. Though the total number of packages per day (Pkgs/day) (average per month) increased from month 1 to month 13, the number of packages handled and sorted per unit of work (Field Time Equivalent (FTE)) increased, as did the packages per handling hour (P/HH) after implementation of the present invention.

DESCRIPTION OF THE PREFERRED EMBODIMENT

Figure 1:
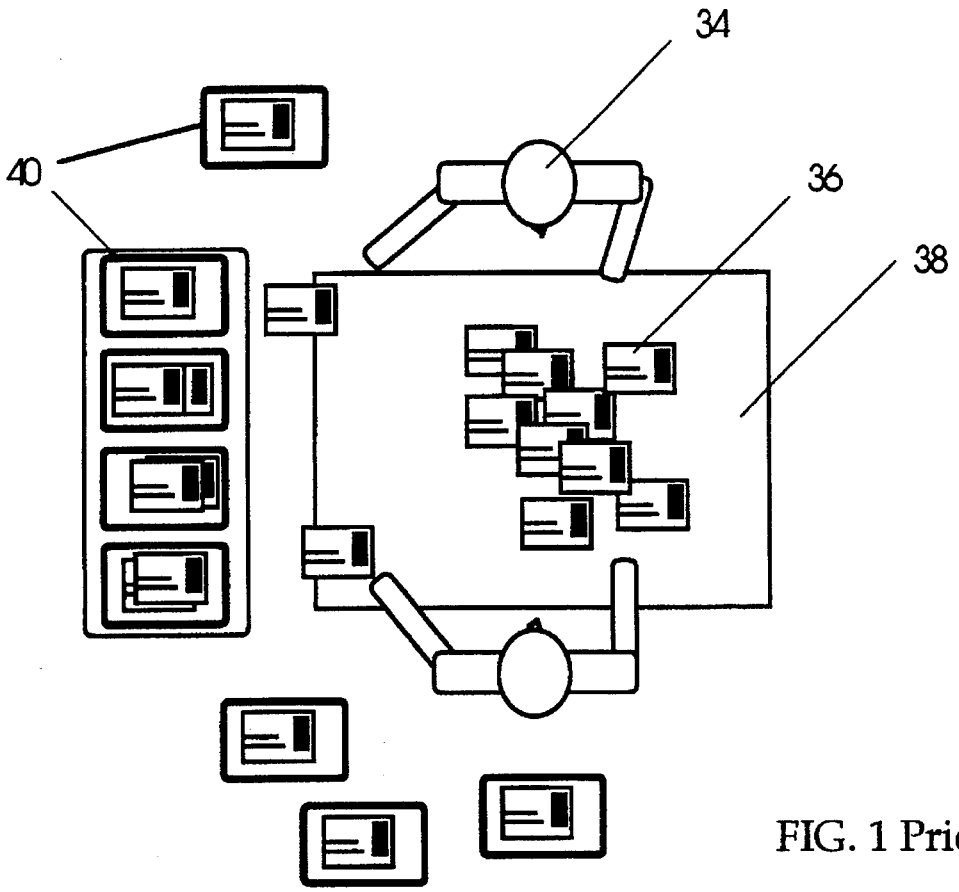
FIG. 1 Prior Art

Description—FIG. 1—Prior Art

FIG. 1 illustrates schematically a common method of sorting documents (36) in the prior art whereby each document (36) is picked at random by two or more sorters (34) from a group of unsorted or rough sorted documents on a single sort table (38) and sorted into 4–6 totes in a destination tote stack (40), located in shelves next to the sort table or into a multiplicity of other destination bags arranged around or near the sort table.

Figure 1A:
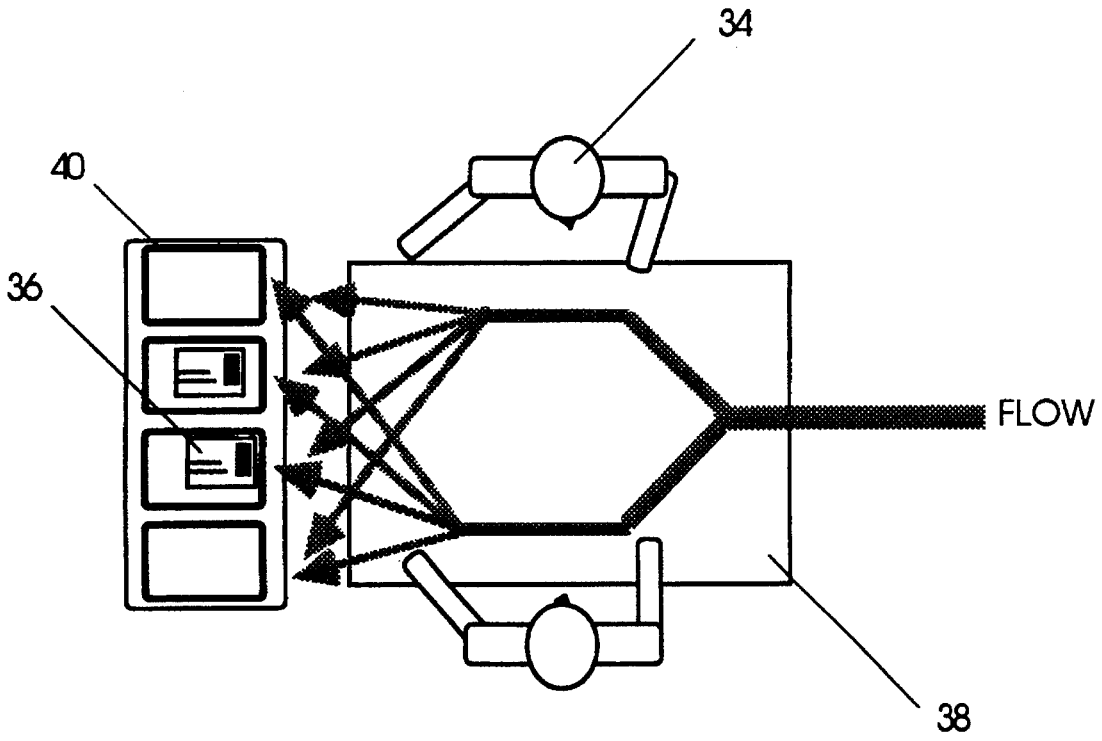
FIG. 1a Prior Art

Description—FIG. 1*a*—Prior Art

FIG. 1*a* illustrates schematically the flow of documents in the sort method shown in FIG. 1—Prior Art. The multiple document paths created by two or more sorters sorting unsorted documents into multiple tote stacks (40) is shown and labeled "FLOW". At the point where document paths cross, collisions do occur and furthermore, documents (36) are sometimes placed into incorrect tote stacks (40), both of which may lead to mis-sorts.

Figure 2:
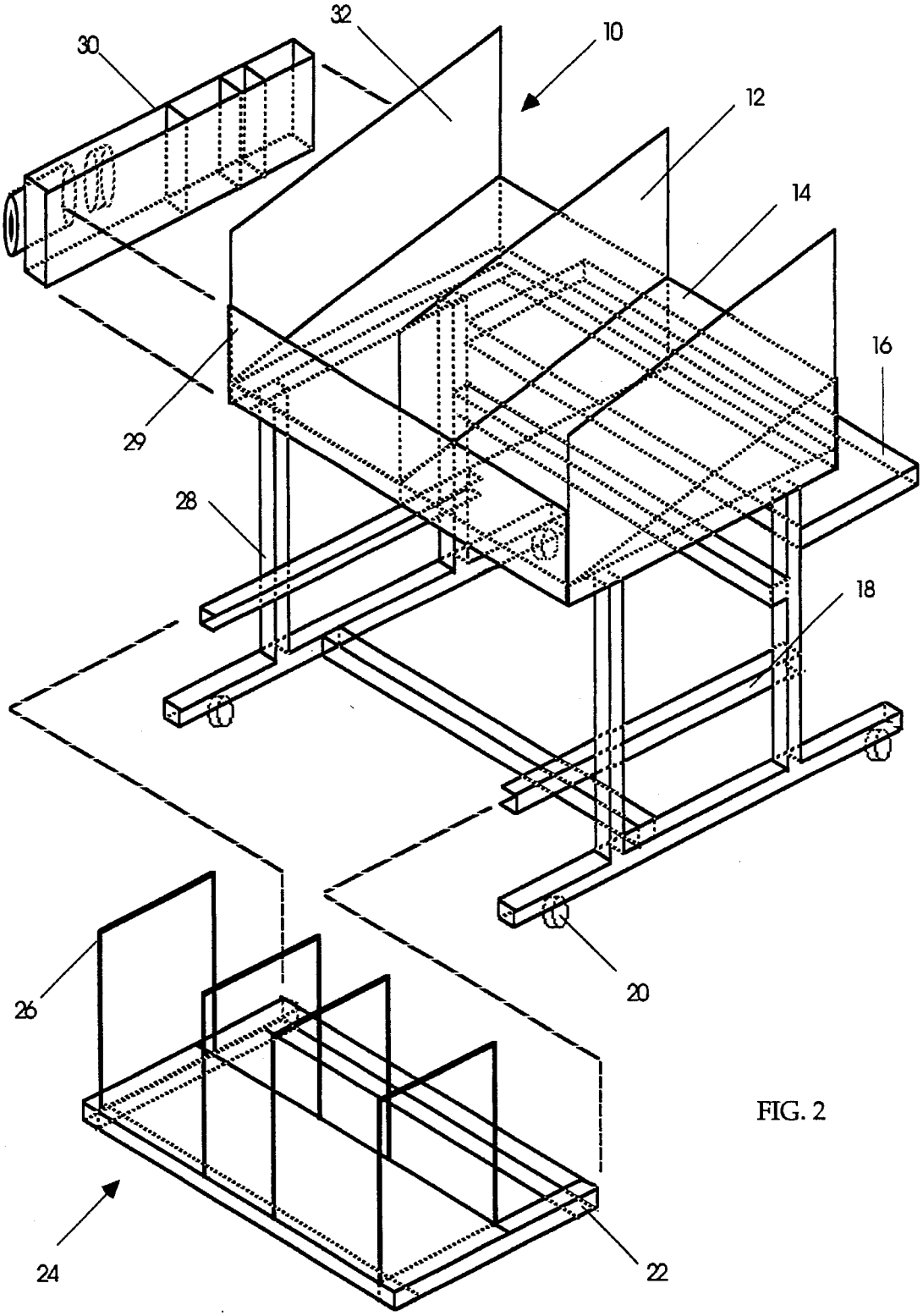

Description—FIG. 2

A typical embodiment of the workstation of the present invention is illustrated in FIG. 2. A workstation (10) is comprised of five main components, an upper workstation (32), a lower workstation (28), a loading shelf (16), a bag holder (24), and an accessory holder (30).

In the preferred embodiment, upper workstation (32) is constructed of a 1.2 cm (0.5 inch) thick high-density polyethylene (HDPE), preferably colored black and possessing a glossy finish. There are various components of upper workstation (32), such as one or more fixed or removable dividers (12) and chutes (14) which are welded together using commonly accepted means for plastics welding. All seams are welded together in such a fashion as to eliminate any openings or crevices into which a document could fall or be lost.

Preferably, chute (14) is inclined from back to front at an angle no less than 14 degrees from the horizontal. Chute (14) is either open in the back of upper workstation (32), or may be partially closed off by a piece of material running horizontally from each outer divider (12). The front of chute (14) is closed off by such a piece, front stop (29), preferably comprised of HDPE, and of a height from bottom of chute (14) of no less than 22.8 cm (9 inches). Front stop (29) is affixed to upper workstation (32). Front of chute (14) is preferably located less than 81.3 cm (32 inches) from floor or supporting surface. Chute (14) width is at least about 22% greater than the longest dimension of the typical document placed into workstation (10). Chute (14) length is preferably about 145% or more of the longest dimension of documents being sorted.

Divider (12) is placed so as to separate workstation (10) into a plurality of segments or sorting compartments or chutes (14) and should be no less than 22.8 cm (9 inches) in height from the bottom of chute (14).

Loading shelf (16) is affixed to the back of workstation (10) at a convenient height, preferably around 73.7 cm (29 inches) from floor. It may also be mounted so as to allow for its adjustment. The dimensions of loading shelf (16) should be sufficient to allow a bag, tote, or other container of unsorted documents or packages to be set upon it for unloading into chute (14). Loading shelf (16) should be a planar surface without a lip or depression into which totes are more difficult to lift.

Lower workstation (28) comprises the support frame for upper workstation (32). Lower workstation (28) is preferably constructed of MIG-welded and/or bolted steel or other similar material with high structural strength and low flexure. Lower workstation (28) includes the support frame assembly, a bag holder guide or guide (18), and casters (20) or similar means for moving workstation (10). Guide (18) is constructed to receive and hold bag holder glider or glider (22), a portion of bag holder (24), and allow it to slide freely in and out. In a preferred embodiment, guide (18) is constructed of 5.1 cm (2 inch) channel iron with a lubricating polymer strip applied to the surface contacting gliders (22). Alternatively, the surface of guide (18) in contact with glider (22) may be periodically grease lubricated. A more expensive design could use heavy-duty, ball-bearing drawer glide/guide assemblies of common design.

In a preferred embodiment, bag holder (24) is constructed of MIG-welded steel and features gliders (22) to engage in guides (18). In a preferred embodiment gliders (22) are constructed of 3.8 cm (1.5 inch) square iron tube to engage in guides (18). Bag holder (24) may also feature one or more devices, such as bag frames (26), for holding or positioning bags, totes, or other containers into which sorted documents or packages are placed. Bag holder (24) is positioned about 40.1 cm (16 inches) from the floor, but this may be varied according to bag sizing and need. In a preferred embodiment, bag frames (26) are constructed to allow a bag to be stretched between them and held open to receive sorted documents. For a 42 cm×32 cm (16.5 inch×12.5 inch) poly gusseted bag, bag frames (26) measure 42 cm (16.5 inches) high and 32 cm (12.5 inches) wide and are placed in pairs, 42 cm (16.5 inches) apart.

Accessory holder (30), in a preferred embodiment is constructed of welded HDPE, PVC tubing, and metal components and is affixed directly to upper workstation (32). One or more accessory holders (30) may be affixed per workstation (10). Placement of accessory holder (30) should be ergonomically correct so as to allow a sorter to reach any of its contents with a minimum of movement. Accessory holder (30) may be comprised of one or a multiplicity of compartments and hangers or holders, each with dimensions and designs to accommodate various tools and accessories used during sorting such as scanners, labels, tags, bags, bag ties, markers, pens, etc.

Other components of workstation (10) may include items such as hooks to hold labels or tags, the hooks being affixed to front stop (29) and labels, placed on the front or back of upper workstation (32) to identify its use or specificity for a particular shipping route or destination.

Workstation (10) may be wholly assembled during manufacture or partially pre-assembled, the various pre-assembled components being bolted or otherwise fastened together at the user's site, thereby minimizing shipping size and volume.

Figure 2A:
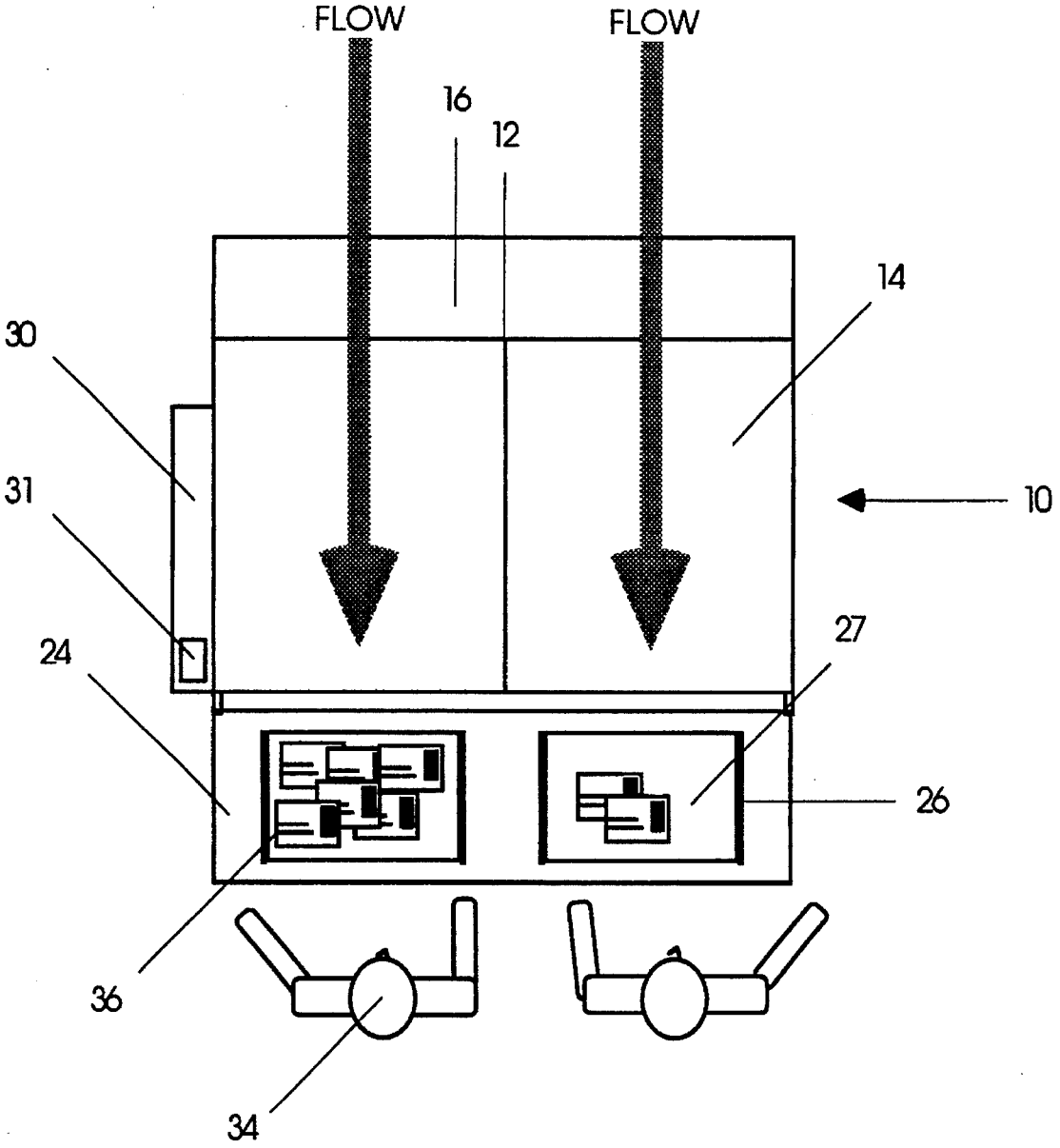

Description—FIG. 2*a*

FIG. 2*a* is a top-view schematic illustration of how the workstation (10) is used in one type of sort. Note the flow of documents, labeled "FLOW", in comparison with FIG. 1*a*—Prior Art is direct, i.e., onto the table, into each chute by destination, and into destination bags (27) after scanning with scanner (31) by sorters.

Figure 3:
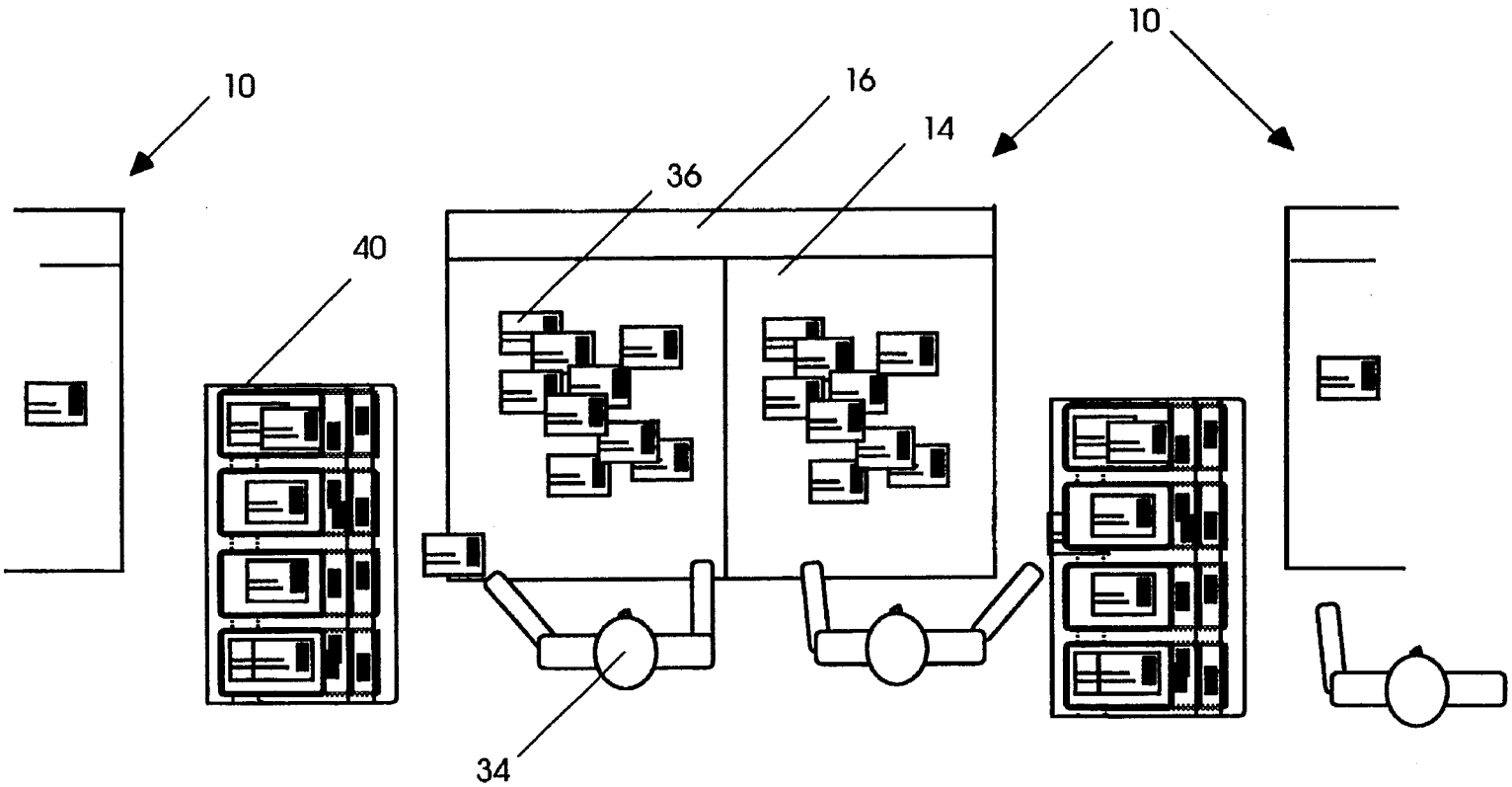

Description—FIG. 3

FIG. 3 illustrates yet another improved sort method over that shown in FIG. 1. Workstations (10) are arranged to allow for destination tote stacks (40) to be placed beside and between multiple workstations. Only a single sorter feeds each opposing side of the destination totes stacks (40) without documents (36), sorted by different sorters (34), ever crossing paths or trajectories. Thus, document collisions and confusion are minimized. Destination tote stacks (40) may also be labeled by destination to further minimize confusion.

Operation—FIG. 2

Documents or packages are brought to the rear of workstation (10). If in bags, totes, or other containers, such containers may be set on loading shelf (16) and not on workstation (10) surface or chute (14). Rather than being poured into chute (14), the documents or packages are unloaded from the container sitting on loading shelf (16) onto chute (14). If workstation (10) is divided into one or more segments, i.e., by dividers (12), unloaded documents may be randomly divided between chutes (14) or directed into specific chutes (14) on the basis of destination. Because each chute (14) is divided from the other chutes (14) on a workstation (10) and features an adequate depth and dimension, documents are not mixed or subject to falling off workstation (10).

In a preferred embodiment, unloaded documents or packages slide down chute (14) and contact front stop (29). Sorter stands in front of workstation (10), generally one sorter per chute (14). When needed for a particular sort, bag holder (24) is extended by sliding out from under upper workstation (32) and empty bags or similar containers placed on it. When not required, bag holder (24) is pushed under upper workstation (32) on the glider (22)/guide (18) assembly.

Documents (36) may be brought to workstation (10) unsorted and sorted as illustrated in FIG. 3. Alternatively, documents (36) may be presorted prior to being brought to workstation (10). A preferred method for pre-sorting occurs as documents (36) are provided the courier, e.g., picked up from customers and loaded into the courier vehicle. As it is placed in the vehicle, each document (36) is sorted by destination (e.g., 1 of 6–10 hub destinations) into an appropriate destination bag or tote. This method is more efficient than sorting all collected documents (36) upon receipt at the local shipping station and before placing them on workstation (10). Accordingly, as each courier arrives at the local shipping station with documents (36) destined for an outbound shipment, each tote is unloaded more or less directly into chute (14) that corresponds to the desired destination. This method enhances the direct flow nature of the sort as shown in FIG. 2*a*.

Using the pre-sort method described above, sorter picks up each document from chute (14), optionally scans document, and places document in the bag located in bag frame (26) in front of him or her. There should be no need to step away from workstation (10) to place each document. Sorter may also easily reach over to accessory holder (30) during the sort to pick up and use scanners or materials for placement onto the document. In addition, upon completion of the sort, sorter may reach over to accessory holder (30) and obtain a printed document or label from a printer attached thereto which is then affixed to the bag and used for routing.

Because all surfaces and joints of upper workstation (32) are sealed and upper workstation (32) is of a color with high contrast to document colors, documents loss is further minimized. Each document placed on upper workstation (32) can be sorted and accounted for.

When all documents in chute (14) have been bagged, the sort and its associated splits are complete. Because of the flow-through nature of the document flow and the readily availability of all accessories and tools, sorts occur very rapidly, all documents are subjected to the sort, and mis-sorts are virtually eliminated.

Because of the integrated, ergonomically-correct design of workstation (10), sorters do not have to bend over, reach, strain, or otherwise make potentially hazardous motions, thus minimizing injury and fatigue. Because sorting tools are readily located in accessory holder (30), sorters perform more efficiently. Furthermore, any computer or machine-based equipment, such as scanners, used during the sort can be pre-programmed for a single chute (14) and its associated destination. This increases sorting accuracy since a mis-sorted document will not be accepted by the scanner. The scanner can act like an alarm because of its pre-set specificity.

Workstations (10) may be positioned modularly in most any configuration by rolling them into place or from one location to another. This feature may be especially critical if document and package volume increases. This may also be advantageous when the number of sorts and their associated splits increase for whatever reason.

Figure 4:
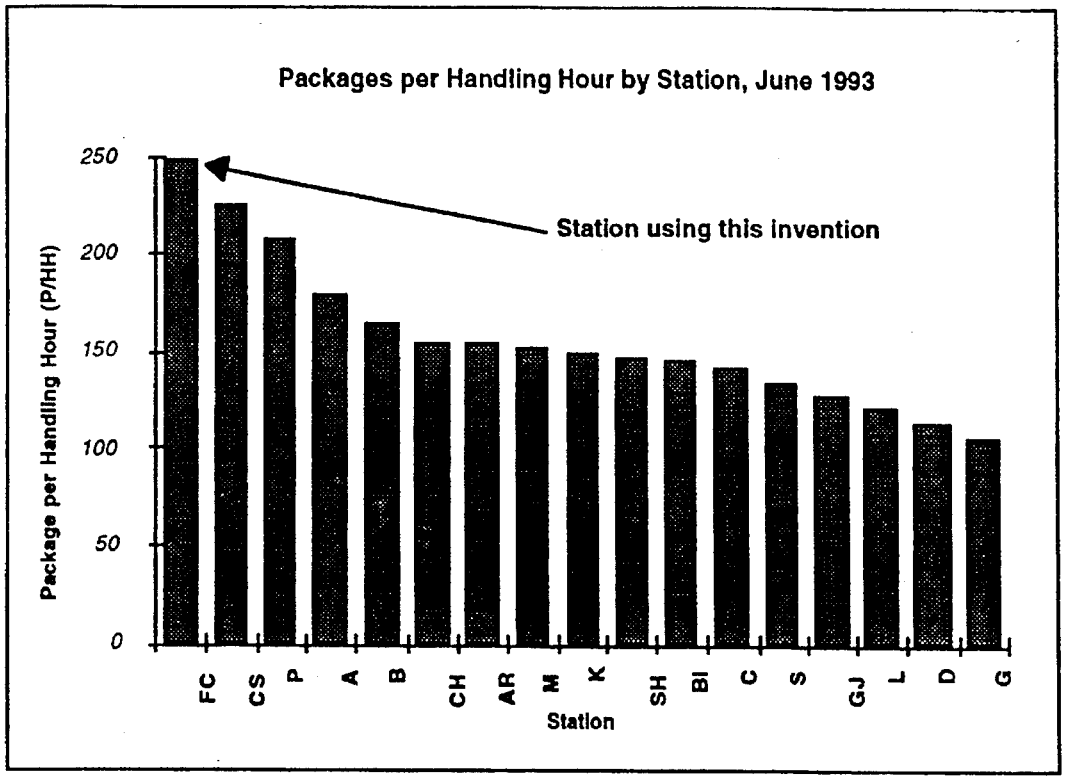

Table 1 contains the data represented in FIG. 4.

TABLE 1

| Station | P/HH |
|---|---|
| FC | 247.8 |
| CS | 225.5 |
| P | 206.6 |
| A | 178.9 |
| B | 164.4 |
| CH | 155 |
| AR | 154.7 |
| M | 152.4 |
| K | 150 |
| SH | 146.5 |
| BI | 145 |
| C | 142 |
| S | 133.3 |
| GJ | 127 |
| L | 120.4 |
| D | 113 |
| G | 105.5 |

Figure 5:
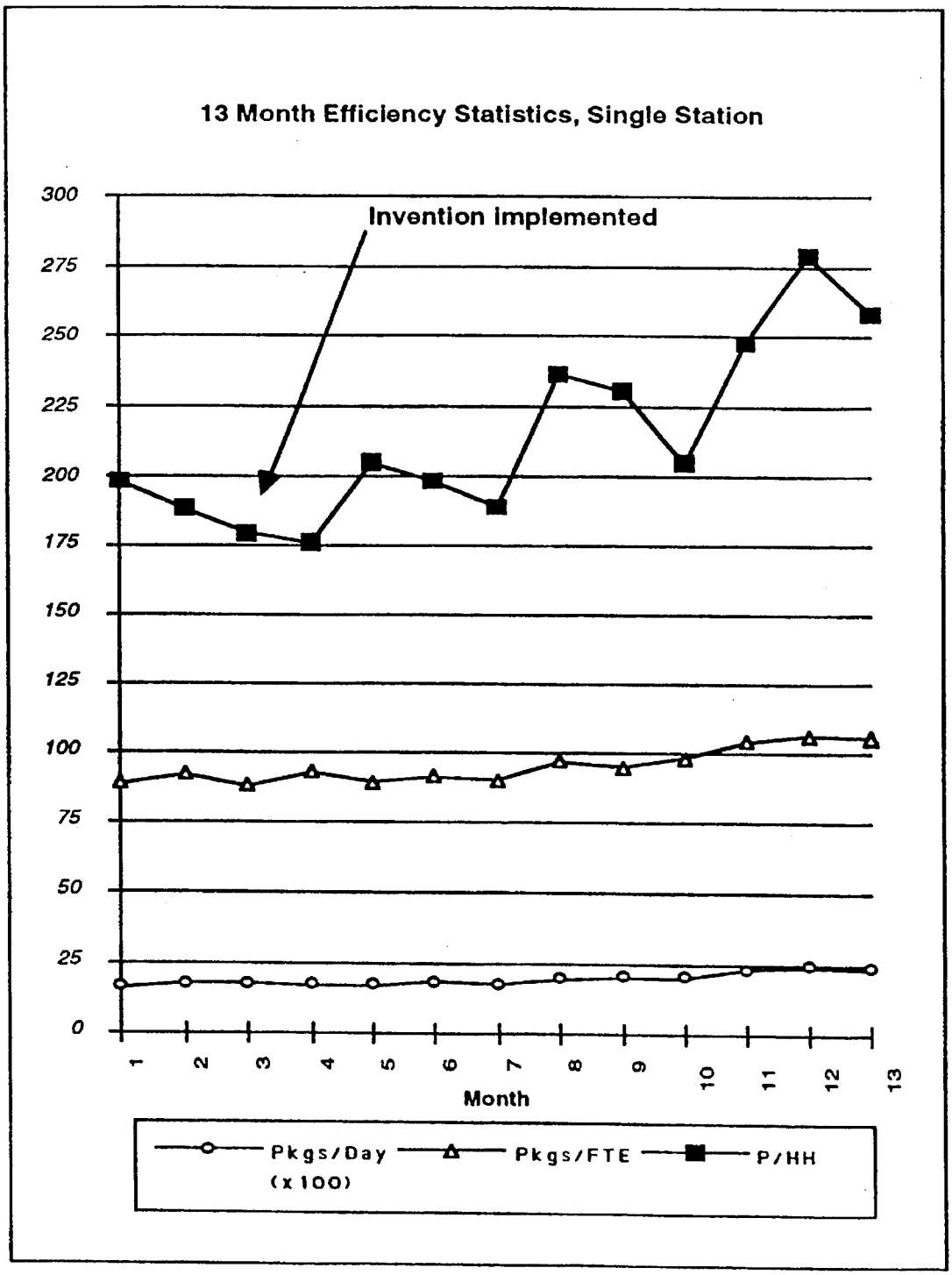

Table 2 contains the data represented in FIG. 5.

TABLE 2

| Month | Pkgs/Day (× 100) | P/HH | Pkgs/FTE |
|---|---|---|---|
| 1 | 15.87 | 198.5 | 88.55 |
| 2 | 17.1 | 188.6 | 91.54 |
| 3 | 17.22 | 179.1 | 87.91 |
| 4 | 16.8 | 175.8 | 92.65 |
| 5 | 16.91 | 205.3 | 88.78 |
| 6 | 18.12 | 198.3 | 90.89 |
| 7 | 17.42 | 189.1 | 89.74 |

TABLE 2-continued

| Month | Pkgs/Day (× 100) | P/HH | Pkgs/FTE |
|---|---|---|---|
| 8 | 19.47 | 236.1 | 96.32 |
| 9 | 20.23 | 230.6 | 94.51 |
| 10 | 20.25 | 205.3 | 97.56 |
| 11 | 22.67 | 247.8 | 103.86 |
| 12 | 24.10 | 278.9 | 105.82 |
| 13 | 23.51 | 258.2 | 104.91 |

Operation—FIG. 2*a*

Documents (36) can be pre-sorted by destination during collection and loaded into chutes (14) of workstation (10), each chute corresponding to the same destination as the documents (36) have been pre-sorted to. Therefore, each group of documents (36), each chute (14), each bag (27) on bag frame (26) shares the same destination. Sorter (34) must then only perform check sorts and manipulate documents (36), e.g., labeling. Using this method, sorter (34) can also make use of scanner (31), attached to workstation (10) or held in accessory holder (30), as a final check-sort and mis-sort alarm.

Before now, individual scanners have not been attached to or associated directly with a single sort table station. In other words, scanners used during a sort have not been chute (14) or workstation (10) specific. Instead, the scanners used are the same scanners carried by the couriers throughout their workday. Courier's scanners may be programmed for a variety of functions, including serving as a time clock and registering package pick up and delivery data. Using this method, scanner (31) is programmed with only a single data point, a single destination. Scanner (31) is also placed in close association with a single chute (14), corresponding with the same destination for which scanner (31) is programmed. Since documents (36) have been pre-sorted by destination, preferably during pickup or collection, the scan applied to each document picked from chute (14) serves to not only record that document (36) is being shipped onward, but also prevents mis-sorts at a final stage of the sorting process. Since scanner (31) is programmed for only a single destination, it will not accept a scan from a document (36) that is actually meant for another destination. Scanner (31) thus acts as an active alarm in addition to its data gathering function.

Using these methods, a sort can proceed whereby each pre-sorted destination group of documents (36) is matched with only one chute (14), one sorter (34), one bag (27) in a bag frame (26), and one scanner (31). Sorting and handling efficiencies are increased and mis-sorts and other errors are virtually eliminated.

Operation—FIG. 3

Another method of sorting documents (36) according to the present invention is shown in FIG. 3. Instead of two or more sorters (34) sorting documents (36) into the same side of a shared set of destination tote stacks (40), sorters (34) sort and feed documents (36) into a shared set of destination tote stacks (40), but do so independently of other sorters. Though the tote stacks (40) may be shared by two sorters (34), they are fed from separate sides of the totes (40) with documents (36) taken from a single chute (14) of workstation (10). Thus, no documents (36) from separate sorters (34) ever cross paths between workstations (10) and tote stacks (40). Each sort is in effect, "localized". This can lead to an increase in sorting efficiency over prior art methods where totes (40) are fed from only one side. Furthermore, because of the flow of sorted documents (36) from workstation (10) to tote stacks (40) and because tote stacks (40) can be arranged between workstations (10), it's possible to arrange totes in a stack, from floor level to as high as the sorter (34) can reach, if desired. Accordingly, an increase in sorting productivity may be realized since documents (36) may be split in more ways per sort. It should also be noted that the sorter (34) doesn't have to move from position in front of workstation (10) during the sort.

SUMMARY, RAMIFICATIONS, AND SCOPE

Accordingly, the reader will see that the workstation of this invention can be used to rapidly and efficiently sort documents and packages. In addition, sorting can be performed using methods which further minimize mis-sorts and increase document handling efficiencies.

Furthermore the workstation and these improved methods feature additional advantages of:

(a) Workstation construction is economical, often costing 50–60% of commonly used sort tables.

(b) Workstations and these improved methods, alone or in combination with each other can be used in conducting both inbound and outbound sorts.

(c) Workstations, by their modular design, meet the requirements of both large and small shipping stations, regardless of document volume or number of personnel.

(d) Documents are subjected to a multitude of check sorts, including at least one by machine scanners, thus virtually eliminating mis-sorts and other shipping errors. Because all check sorts occur during the normal handling or processing of documents, no additional document handling time is necessary.

(e) Full utility is made of machine or computer scanning/tracking systems by using them to also operate as mis-sort alarms.

(f) An association is made between each document and its destination hub from the moment it enters the system and throughout its handling. Separate sorters use separate totes or bags, separate chutes, and separate scanners in a segregated system to avoid mis-sorts. Each sort is localized.

(e)The integrated bag holder means no document must ever be tossed or thrown any distance to its respective bag eliminating the chance for document loss or collisions. Depending on the sort, the bag holder is simply extended from or pushed under the workstation.

Although the description above contains many specificities, these should not be construed as limiting the scope of the invention but merely serve to illustrate some of the presently preferred embodiments of this invention. For example, upper workstation (32) may also be constructed of polished metal, workstation may comprised a multitude of segments, divided by dividers and even built in a circular or semi-circular shape, etc. In addition, workstation and the improved methods described here may be used to sort regular mail or parcels and may even have application to manual sorting of parts or other objects for assembly or transport.

Thus the scope of the invention should be determined by the appended claims and their legal equivalents, rather than by the examples and specific embodiments given.

I claim:

1. A work station device for sorting documents comprising:

a) a sorting surface of sufficient size to be used by a human during a document sorting operation, constructed from rigid materials, said sorting surface being an inclined planar surface with the sorting surface at the back of the work station being higher than the front where the human performs the document sorting operation, b) a plurality of rigid dividers positioned perpendicular to said inclined planar surface, said dividers being affixed to the sorting surface such that no voids or cavities are present into which said documents could fall or lodge.

c) a support frame for holding said sorting surface at a height convenient for a human performing a document sort, d) a horizontally sliding glider engaged to an guide for receiving said glider, said guide affixed to said support frame beneath said sorting surface, wherein said glider provides a holder for holding containers into which said documents are placed, and e) a front stop affixed to the work station where the document sorting operation is performed so as to confine the documents for sorting to the sorting surface.

2. The work station of claim 1 wherein said sorting surface is constructed of high-density polyethylene or other plastic.

3. The work station of claim 1 wherein said sorting surface is of a color generally contrasting with the color of said objects being sorted.

4. The work station of claim 1 wherein said horizontally sliding means possesses a rigid surface and holding means for said holding containers.

5. The work station of claim 1 further including an attached shelf onto which can be placed containers of said objects for unloading onto said sorting surface.

6. The work station of claim 1 comprising three of said dividers to define two areas of said sorting surface for use by only one human sorter per area.

7. The work station of claim 1 further including one or more attached holding means to contain tools and supplies useful during a sorting operation, said holding means attached to a surface of a perpendicular divider that is exterior to the document sort area and proximate to the front of the work station where the human performs the document sorting operation.

8. The work station of claim 7 wherein said holding means includes means for holding a computer or machine scanner.

9. The workstation of claim 1, wherein the sorting surface is inclined at least about 14° from horizontal.

10. A method of manually sorting documents comprising the steps of:

a) sorting said documents into a group by destination, b) programming a computer or machine scanner for a single document destination and to alarm the user if a document has been incorrectly sorted, c) scanning said sorted documents with said computer or machine scanner, and d) removing any incorrectly sorted documents identified by said alarm from said group.

11. The method of claim 10, wherein the scanner is a courier computer scanner.

12. The method of claim 10, wherein one computer or scanner programmed for a single document destination is used for a sorting workstation.

* * * * *